United States Patent [19]

Hirose

[11] Patent Number: 4,867,656

[45] Date of Patent: Sep. 19, 1989

[54] FREE PISTON FOR USE IN AN ELECTROMAGNETIC RECIPROCATING COMPRESSOR

[75] Inventor: Fuminori Hirose, Tokyo, Japan

[73] Assignee: Nitto Kohki Co., Ltd., Tokyo, Japan

[21] Appl. No.: 199,795

[22] Filed: May 26, 1988

[30] Foreign Application Priority Data

May 30, 1987 [JP] Japan ..... 62-84781[U]

[51] Int. Cl.[4] ..... F04B 21/04

[52] U.S. Cl. ..... 417/550; 417/552; 92/107

[58] Field of Search ..... 417/274, 552, 550; 92/60.5, 181 P, 181 R, 248, 249, 183, 60; 29/156.5 R, 156.5 A, 156.63

[56] References Cited

U.S. PATENT DOCUMENTS

| | | | |
|---|---|---|---|
| 1,379,694 | 5/1921 | Pownall | 92/181 |
| 1,470,548 | 10/1923 | Spohrer | 417/550 |
| 2,194,726 | 3/1940 | Thomas | 417/552 |
| 2,296,883 | 9/1942 | Trask | 417/550 |
| 2,622,792 | 12/1952 | Ramclow | 417/550 |
| 2,792,790 | 5/1957 | Capps | 417/550 |
| 3,402,644 | 9/1968 | Geiger et al. | 29/156.5 R |
| 4,255,090 | 3/1981 | Pratt | 417/238 |
| 4,553,472 | 11/1985 | Munro et al. | 29/156.5 R |
| 4,648,308 | 3/1987 | Matsui et al. | 29/156.5 R |

FOREIGN PATENT DOCUMENTS

| | | | |
|---|---|---|---|
| 51-332226 | 3/1976 | Japan . | |
| 7714344 | 8/1978 | Netherlands | 92/249 |

OTHER PUBLICATIONS

Willis T946,012 May 4, 1976 defensive publication.

*Primary Examiner*—Leonard E. Smith
*Assistant Examiner*—Robert N. Blackmon
*Attorney, Agent, or Firm*—Nixon & Vanderhye

[57] ABSTRACT

A free piston to be slidably inserted in the cylinder of an electromagnetic reciprocating compressor. The piston has a partition wall dividing the inner space of the cylinder into chambers, and a rod connected to the partition wall. The partition wall has an air hole. A valve member is attached to the front surface of the partition wall, and usually closes the air hole of the partition wall. The rod extends rearwardly from the rear-end surface of the partition wall. The rod has a substantially conical hole which extends rearwardly from the front-end surface of the partition wall. The piston further comprises a retainer cap closing the opening of the substantially conical hole and holding the valve member in an openable condition.

2 Claims, 1 Drawing Sheet

FREE PISTON FOR USE IN AN ELECTROMAGNETIC RECIPROCATING COMPRESSOR

BACKGROUND OF THE INVENTION

1. Field of the Invention

The present invention relates to a free piston for use in an electromagnetic reciprocating compressor and, more particularly, to an improved one-way air valve to be fitted on the partition wall of the free piston.

2. Description of the Related Art

Electromagnetic reciprocating compressors are generally used as air-supply devices in massage apparatuses, spraying devices, and aeration devices incorporated in sewage disposal facilities. Each electromagnetic reciprocating compressor comprises a cylinder and a free piston inserted in the cylinder and capable of reciprocating. The free piston is moved in one direction by a spring, and in the opposite direction by an electromagnet. In other words, the piston is driven back and forth within the cylinder by a drive means having the spring and the electromagnet, thus compressing air and subsequently supplying the compressed air to a device where the compressed air is needed.

A conventional electromagnetic reciprocating compressor is disclosed in Japanese Patent Publication No. 57-3226. FIG. 1 shows a portion of a free piston incorporated in the electromagnetic reciprocating compressor of the general type. As a illustrated in this figure, the piston is inserted in a cylinder, both slidably and rotatably. The partition wall, i.e., a part of the piston head, partitions the inner space of the cylinder into a pressure chamber and a open chamber. The pressure chamber is formed between the distal end of the piston head and the inner wall of the cylinder head. The open chamber is formed between the proximal end of the piston head and the inner wall of the cylinder. An air hole is formed at the partition wall of the piston head. This hole is usually closed by a disc-shaped valve made of rubber and attached to that surface of the partition wall which opposes the cylinder head. The disc-shaped valve is mounted to the partition wall by a backing plate and screws as is shown in FIG. 1, or by a retainer holding the valve and a ring fastening the retainer to the partition wall.

As is generally known, the air hole formed at the partition wall, and the disc-shaped valve constitute a one-way valve of a free piston for use in an electromagnetic reciprocating compressor. The one-way valve opens when the piston moves away from the cylinder head. When the valve thus opens, the air is introduced into the pressure chamber from the open chamber. Hence, every time the piston moves backward, fresh air flows into the pressure chamber.

As is shown in FIG. 1, a recess is formed in the front surface of the head of the free piston, and a substantially conical hole is cut in the rod-shaped portion of the piston. The recess, the conical hole, and the inner wall of the cylinder head usually form an air-compressing chamber. Air is compressed in this chamber as the piston moves toward its upper dead point. The air thus compressed within the chamber flows from the cylinder through the exhaust valve mounted on the circumference of the cylinder. As the piston further moves toward the upper dead point, it closes the exhaust valve, and the residual air is compressed within the air-compressing chamber. When the pressure of the air within the chamber rises to a predetermined value, the compressed air functions as a bumper, preventing the piston from moving further to abut against the cylinder head.

The conical hole, which is formed in the rod-shaped portion of the piston, helps to prevent the piston from being deformed while the piston is being molded by die-casting. The conical hole has such a size as to adjust appropriately the resonance frequency of the piston to that of the spring biasing the piston in the forward direction. In some cases, the conical hole need not be formed in the rod-shaped portion of the piston.

The one-way air valve is composed of a relatively great number of parts. These parts are complex and difficult to machine, and much time is required to assemble the one-way valve. Further, since the conical hole opens to the recess of the piston head, the air-compressing chamber is too large to raise the air pressure within it to a value sufficient to prevent the piston from abutting against the cylinder head.

SUMMARY OF THE INVENTION

It is accordingly the object of this invention to provide a free piston for use in an electromagnetic reciprocating compressor, which has a one-way air valve of a simple structure, which can therefore be easily assembled, and whose head is reliably prevented from abutting against the head portion of the cylinder in which the piston is inserted.

The object of the invention is attained by a free piston which is slidably inserted in the cylinder of an electromagnet reciprocating compressor, and comprises a head having a partition wall dividing the inner space of the cylinder into two chambers and a rod connected to the head. The partition wall has an air hole. A valve member is attached to that surface of the partition wall which opposes the cylinder head, such that the valve member closes the air hole. The rod extends rearward from the rear end of the head. A substantially conical hole is cut in the rod, and extends from the front end of the head. A retainer cap is fitted to the front end portion of the head, closing the conical hole and holding the valve member in an openable condition.

As has been described, the retainer cap performs two functions, that is, to hold the valve which forms a one-way air valve, and to close the conical hole made in the rod of the piston. In addition, it is extremely easy to fix the retainer cap to the front end portion of the head. The piston is comprised of relatively small number of components, and can thus be assembled within a comparatively short time. The free piston according to the present invention can, therefore, be manufactured at low cost.

Moreover, since the conical hole cut in the rod is closed by the retainer cap, the air-compressing chamber has a relatively small volume, and the air pressure within this chamber can rise to a value sufficiently great to prevent the piston head from abutting against the cylinder head. The durability of the free piston is therefore improved. Further, when a larger retainer cap is fitted to the front end portion of the piston head, the volume of the air-compressing chamber is reduced, and the bumping effect on the piston can be changed to a degree suitable for a compressor of different specifications.

DETAILED DESCRIPTION OF THE PREFERRED EMBODIMENT

An embodiment of the present invention will now be described, with reference to the accompanying drawing.

Figure 1:
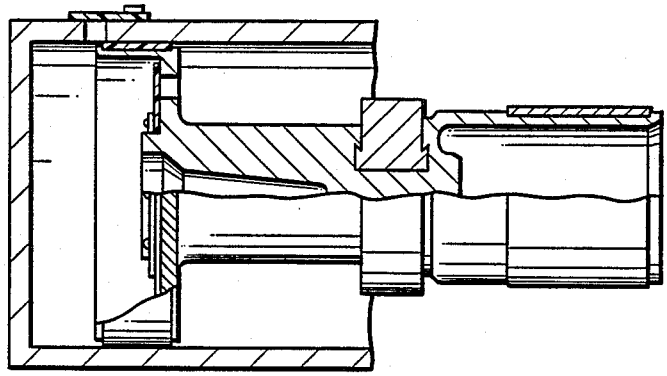
FIG. 1 (PRIOR ART)
FIG. 1 is a partially sectional view showing a portion of a conventional electromagnetic reciprocating compressor.
Figure 2:
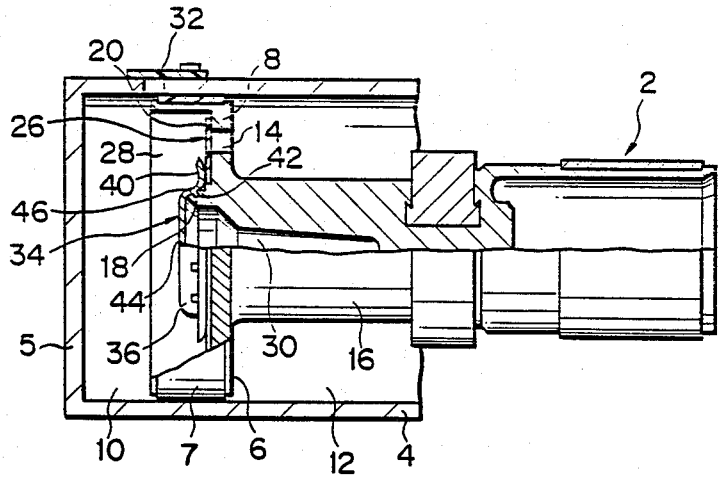
FIG. 2 is a partially sectional view illustrating a free piston according to the present invention, which is inserted in the cylinder of an electromagnetic reciprocating compressor.

FIG. 2 shows a free piston according to this invention, which is designed for use in an electromagnetic reciprocating compressor. As is shown in this figure, free piston 2 has head 6 and rod 16. Piston 2 is inserted in cylinder 4, both rotatably and slidably. Wear-reducing sheet 7 is wound around the outer periphery of head 6, and is in contact with the inner periphery of cylinder 4. Partition wall 8, which is the base portion of head 6, divides the inner space of cylinder 4 into pressure chamber 10 and open chamber 12. Pressure chamber 10 is defined between the front surface of head 6 and the inner wall of cylinder head 5. Open chamber 12 is defined between the rear surface of head 6 and the inner wall of cylinder 4. Open chamber 12 communicates with the atmosphere. Air hole 14 is cut in partition wall 8. This air hole is usually closed by disc-shaped valve member 20 made of rubber and attached to the front surface of partition wall 8. Valve member 20 is held in an operable condition by means of retainer cap 34.

Air hole 14 made in partition wall 8, and valve member 20 attached to partition wall 8 constitute one-way air valve 26. This one-way valve opens when piston 2 moves away from cylinder head 5, or in the backward direction. When valve 26 opens, air is introduced into pressure chamber 10 form open chamber 12. Hence, every time piston 2 moves backward, fresh air flows into pressure chamber 10.

As is shown in FIG. 2, recess 28 is formed in the front portion of piston head 6, and a blind hole 30 which is substantially conical shape is cut in rod 16. Conical hole 30, which extends rearwardly from the front end of rod 16, and pressure chamber 10 constitute an air-compressing chamber. As piston 2 moves toward its upper dead point, the air is compressed within this air-compressing chamber. Part of the compressed air flows out of cylinder 4 through exhaust valve 32 mounted on the outer circumference of cylinder 4. As piston 2 further moves toward the upper dead point, piston head 6 closes exhaust valve 32, and the residual air within the air-compressing chamber is then compressed to a greater extent. The air pressure increases so much that the compressed air prevents piston 2 from approaching cylinder head 5. Thus, piston 2 stops before abutting against cylinder head 5.

Conical hole 30 has been formed in rod 16, in order to prevent piston 2 from being deformed during the die-cast molding of piston 2. Once hole 30 has been cut in rod 16, it is not absolutely necessary. Therefore, hole 30 is closed by retainer cap 36.

The one-way air value use in the embodiment of this invention will be explained in more detail. As is shown in FIG. 2, a projecting or raised lip 18 protrudes from the center of the bottom portion of recess 28. projecting lip 18 is axially aligned with conical hole 30. Retainer cap 34 covers the lip 18, closing the opening of conical hole 30. Retainer cap 34 comprises cap portion 36, valve-holding portion 40, and claws 42. Cap portion 36 has been made from a plate by means of deep drawing, and has bottom 44 and circumferential portion 46. Circumferential portion 46 resiliently squeezes lip 18, whereas bottom 44 closes the opening of hole 30, thus closing communication between the hole 30 and the air-compressing chamber 10.

Valve-holding portion 40 of retainer cap 34 is a flange extending from circumferential portion 46 of cap portion 36. Portion 40 is elastic, and is curved as is shown in FIG. 2. It resiliently holds valve member 20 onto the front surface of partition wall 8, as long as cap portion 36 is mounted on hollow cylindrical projection 18.

Claws 42 of retainer cap 34 protrude from circumferential portion 46 toward the axis of cap 34. These claws bite into the outer circumference of lip 18 when cap portion 36 is mounted thereto. Thus, claws 42 prevent retainer cap 34 from slipping from lip 18. Retainer cap 34 can easily be made by means of a plastic processing such as deep drawing.

As can be understood from the above, retainer cap 34 can be easily mounted on hollow cylindrical projection 18. Once cap 34 has been thus fitted to projection 18, valve-holing portion 40 of cap 34 firmly holds valve member 20 onto partition wall 8, due to the spring force of portion 40, and bottom 44 of cap 34 closes the opening of conical hole 30, thus completely disconnecting conical hole 30 of rod 16 from the air-compressing chamber 10. Moreover, once cap 3 has been fitted to projection 18, claws 42 bite into the outer circumference of projection 18, whereby retainer cap 34 can no longer slip from projection 18 easily.

What is claimed is:

1. A free piston for use in an electromagnetic reciprocating compressor, said piston being slidably inserted into a cylinder having a cylinder head, and comprising a head portion having a partition wall defining a closed chamber in an inner space of the cylinder on the side of the cylinder head and also having an air passageway, valve means attached to that part of the partition wall which faces the cylinder head so as to open or close the air passsageway in response to the sliding movement of the piston, and a rod portion extending rearwardly from a rear surface of the head portion and having a blind hole open at a front surface of the head portion, wherein said partition wall is provided at the front surface with a retainer cap closing the open end of the blind hole made in the rod portion and holding the valve means in openable and closable condition;

the head portion is provided with a raised lip surrounding the open end of the blind hole open at the front surface of said head portion; and the retainer cap is engaged with an outer surface of said raised lip so as to close the open end of the blind hole.

2. The free piston according to claim 1, wherein the retainer cap is formed flat and comprises a bottom portion closing the blind hole made in the rod portion and an outer peripheral portion having a member for holding the valve means.

* * * * *